US007866324B2

(12) United States Patent
Jupe et al.

(10) Patent No.: US 7,866,324 B2
(45) Date of Patent: Jan. 11, 2011

(54) CIGARETTE AND FILTER WITH CELLULOSIC FLAVOR ADDITION

(75) Inventors: Richard Jupe, Richmond, VA (US); Rowland W. Dwyer, Glen Allen, VA (US); Donald E. Laslie, Midlothian, VA (US); Arlington L. Finley, Midlothian, VA (US); Barbara G. Taylor, Midlothian, VA (US); Cecil M. Smith, Disputanta, VA (US); Vivian E. Willis, Maidens, VA (US)

(73) Assignee: Philip Morris USA Inc., Richmond, VA (US)

( * ) Notice: Subject to any disclaimer, the term of this patent is extended or adjusted under 35 U.S.C. 154(b) by 1130 days.

(21) Appl. No.: 11/346,429

(22) Filed: Feb. 3, 2006

(65) Prior Publication Data

US 2006/0272662 A1 Dec. 7, 2006

Related U.S. Application Data

(60) Provisional application No. 60/649,543, filed on Feb. 4, 2005.

(51) Int. Cl.
*A24D 3/04* (2006.01)

(52) U.S. Cl. ..... 131/335; 131/336; 131/341; 131/344; 131/274

(58) Field of Classification Search ..... None
See application file for complete search history.

(56) References Cited

U.S. PATENT DOCUMENTS 2,978,446 A 4/1961 Battista et al.
3,351,071 A * 11/1967 Belfort ..... 131/342
3,539,365 A 11/1970 Durand et al.
3,540,456 A * 11/1970 McGlumphy et al. ..... 131/337
4,281,671 A 8/1981 Bynre et al.
4,357,950 A 11/1982 Berger
4,729,391 A 3/1988 Woods et al.
4,837,030 A 6/1989 Valorose, Jr. et al.

(Continued)

FOREIGN PATENT DOCUMENTS

EP 0464324 A 1/1992

(Continued)

OTHER PUBLICATIONS

Chris Vervaet et al., "Extrusion-Spheronization—A Literature Review", *International Journal of Pharmaceutics* 116 (1995) 131-146.

(Continued)

*Primary Examiner*—Philip C Tucker
*Assistant Examiner*—Michael J Felton
(74) *Attorney, Agent, or Firm*—Buchanan Ingersoll & Rooney PC

(57) ABSTRACT

A cigarette having a multi-component filter wherein an upstream sorbent removes at least one constituent from mainstream tobacco smoke passing through the filter and a downstream flavor segment compensates for taste lost to the sorbent. The flavor component includes cellulosic flavor bearing granules which release volatile flavor constituents into the mainstream smoke under ambient conditions. The cellulosic granules include microcrystalline cellulose or other cellulosic material which can be formed into a paste with the flavor additive, extruded and spheronized to form the flavor granules.

15 Claims, 6 Drawing Sheets

U.S. PATENT DOCUMENTS

| | | | | | |
|---|---|---|---|---|---|
| 4,844,910 | A | | 7/1989 | Leslie et al. | |
| 4,867,985 | A | | 9/1989 | Heafield et al. | |
| 4,867,987 | A | | 9/1989 | Seth | |
| 4,889,144 | A | * | 12/1989 | Tateno et al. | 131/331 |
| 5,366,472 | A | | 11/1994 | Hillstead | |
| 5,366,742 | A | * | 11/1994 | Tuason et al. | 426/96 |
| 5,725,886 | A | | 3/1998 | Erkoboni et al. | |
| 5,985,323 | A | | 11/1999 | Augello et al. | |
| 6,026,820 | A | | 2/2000 | Baggett, Jr. et al. | |
| 2002/0166563 | A1 | * | 11/2002 | Jupe et al. | 131/331 |
| 2005/0241656 | A1 | | 11/2005 | Kennison | |

FOREIGN PATENT DOCUMENTS

| | | | |
|---|---|---|---|
| WO | 03/059096 | A | 7/2003 |

OTHER PUBLICATIONS

Leffingwell et al., Tobacco Flavoring for Smoking Products (1972).

Cigarette Additives: 599 Additives Allowed in US Cigarettes—the G.R.A.S. List, downloaded from website: www.otdirect-cigarettes.com on Feb. 7, 2005, pp. 1-43.

FEMA Publications & Sites, List of publications available from Flavor and Extract Manufacturer's Association, downloaded from website: www.femaflavor.org on Feb. 7, 2005, pp. 1-3.

International Search Report and Written Opinion dated Jun. 22, 2006 for PCT/IB2006/000398.

International Preliminary Report on Patentability dated Aug. 7, 2007 for PCT/IB2006/000398.

* cited by examiner

CIGARETTE AND FILTER WITH CELLULOSIC FLAVOR ADDITION

CROSS-REFERENCE TO PRIORITY/PROVISIONAL APPLICATIONS

This application claims priority under 35 U.S.C. §119 of U.S. Provisional Application Ser. No. 60/649,543, filed Feb. 4, 2005, hereby expressly incorporated by reference and assigned to the assignee hereof.

FIELD OF THE INVENTION

The present invention relates to smoking articles such as cigarettes, and in particular, to cigarettes that include filter segments comprising a flavor releasing component and optional sorbent for removal of gas phase constituents from mainstream smoke.

BACKGROUND OF THE INVENTION

Smoking articles, particularly cigarettes, generally comprise a tobacco rod of shredded tobacco (usually, in cut filler form) surrounded by a paper wrapper, and a cylindrical filter aligned in an end-to-end relationship with the tobacco rod. Typically, the filter includes a plug of cellulose acetate tow attached to the tobacco rod by tipping paper. Ventilation of mainstream smoke is achieved with a row or rows of perforations about a location along the filter. Such ventilation provides dilution of drawn mainstream smoke with ambient air to reduce the delivery of tar.

Particulate efficiency of a filter is typically resolved as the level of tar into a filter minus tar level out of the filter divided by the tar level into the filter. Ventilation tends to lower particulate efficiency of a filter.

Upon lighting a cigarette, a smoker draws mainstream smoke from the coal at the lit end of the cigarette. The drawn cigarette smoke first enters the upstream end portion of the filter and then passes through the downstream portion adjacent the buccal (mouth) end of the cigarette.

Mainstream smoke from carbon filters tend to have a flavor note that is contrary to consumer preferences, and that therefore their employment in commercially offered cigarettes has not been heretofore widespread.

It would be desirable to provide a cigarette having a cigarette filter incorporating a sorbent such as carbon and/or other materials capable of absorbing and/or adsorbing gas phase constituents present in mainstream cigarette smoke, while providing favorable absorption/adsorption, dilution and drawing characteristics, and adding flavor to the filtered smoke so as to enhance consumer acceptability.

Furthermore, it would be desirable to provide such a filter with desirable residence time in the adsorbent/absorbent-containing region while simultaneously achieving a pressure drop downstream of the dilution region and the adsorbent/absorbent so as to provide acceptable drawing characteristics of puffs of smoke having reduced gas phase constituents but with acceptable taste and resistance-to-draw.

SUMMARY

In accordance with one embodiment, a smoking article such as a cigarette comprises a tobacco rod and a multi-component filter comprising a sorbent and a flavor-releasing filter segment located downstream of the sorbent. In the preferred embodiment, the sorbent is also flavor-bearing and comprises high surface area, activated carbon. As mainstream smoke is drawn through the upstream portion of the filter, gas phase smoke constituents are removed and flavor is released from the sorbent. Thereafter additional flavor is released into the mainstream smoke as it passes through the flavor-releasing filter segment. Ventilation is provided to limit the amount of tobacco being combusted during each puff and is arranged at a location spaced downstream from the sorbent to lower mainstream smoke velocity through the sorbent. Preferably, the sorbent comprises a carbon bed of at least 90 to 120 mg or greater of carbon in a fully filled condition or 160 to 180 mg or greater of carbon in a 85% filled condition or better, which in combination with other features provides a flavorful cigarette that achieves significant reductions in gas phase constituents of the mainstream smoke, including 90% reductions or greater in 1,3-butadiene, acrolein, isoprene, propionaldehyde, acrylonitrile, benzene, toluene, styrene, and 80% reductions or greater in acetaldehyde and hydrogen cyanide.

Both the downstream flavor releasing segment and the flavor-bearing carbon bed contribute a flavor note throughout all puffs during smoking, but the flavor contribution of the downstream segment is greater during the initial puffs than during later puffs. Conversely, the flavor contribution of the carbon bed is greater during the later puffs. Flavor delivery is therefore balanced and consistent throughout the entire smoking process.

Advantageously, the filter addresses the desirability of achieving optimum residence times for the smoke in the regions of the filter bearing the sorbent material while also achieving favorable dilution of the smoke with ambient air and inducing an acceptable resistance to draw ("RTD") as is expected by most smokers.

In another embodiment, a cigarette filter is provided wherein cellulosic flavor-containing granules located in the filter can release desired flavorant additives into mainstream smoke passing through the filter. The filters can be used in cigarettes with or without upstream sorbent material and in traditional or non-traditional cigarettes such as cigarettes smoked in electrically heated cigarette smoking systems.

In a further embodiment a cigarette comprising a tobacco rod and a multi-component filter comprising a sorbent and ventilation along the filter is provided, wherein the sorbent and ventilation are constructed and arranged to substantially remove of at least one smoke constituent from mainstream tobacco smoke as mainstream smoke is drawn through the filter, and flavor-releasing cellulosic granules are arranged to release flavor to mainstream smoke, the flavor-releasing cellulosic granules being located downstream of the sorbent in a direction of mainstream smoke drawn through the filter.

In another embodiment, a multi-component filter of a smoking article comprising an absorbent bearing segment adjacent an upstream end portion of the filter is provided, wherein the absorbent bearing segment having a particulate efficiency in the range 10-20% and a lesser RTD; an RTD-inducing segment including a flow constriction and ventilation, the RTD-inducing segment being located at an intermediate location along the filter, the RTD-inducing segment having a particulate efficiency in the range of 10-20%; and flavor-releasing cellulosic granules at a downstream location along the filter, the flavor-releasing cellulosic granules having a particulate efficiency in the range 10-20% and a lesser RTD; the lesser RTD being less than an RTD of the RTD inducing segment.

In another embodiment, a cigarette comprising a tobacco rod and a multi-component filter is provided, wherein the multi-component filter comprising at least one sorbent-bearing segment constructed and arranged to remove at least one smoke constituent from mainstream tobacco smoke as mainstream smoke is drawn through the filter, and at least one flavor-releasing segment constructed and arranged to release flavor to mainstream smoke, the flavor-releasing segment being located downstream of the sorbent-bearing segment in a direction of mainstream smoke drawn through the filter and the flavor-releasing segment comprising cellulosic flavor bearing granules.

In a further embodiment, a cigarette comprising a tobacco rod and a multi-component filter comprising: sorbent and a flavor-releasing filter segment located downstream of the sorbent is provided, wherein the sorbent comprising high surface area, activated carbon so that as mainstream smoke is drawn through the upstream portion of the filter, gas phase smoke constituents are removed and flavor is released from the adsorbent bed and thereafter additional flavor is released into the mainstream smoke as it passes through the flavor-releasing filter segment; filter ventilation arranged at a location spaced downstream from the sorbent so as to lower mainstream smoke velocity through the sorbent; and the activated carbon comprising at least 90 to 120 mg or greater of the carbon in a fully filled condition or 160 to 180 mg or greater of the carbon in a 85% filled condition or better; wherein the cigarette achieves a significant reduction in a gas phase constituent of the mainstream smoke.

In another embodiment, a cigarette comprising a tobacco rod and a multi-component filter comprising a downstream flavor segment and an upstream sorbent segment is provided, wherein the flavor segment comprises cellulosic flavor bearing granules and the sorbent comprises a high surface area, activated carbon, the carbon being present such that as mainstream smoke is drawn through the upstream portion of the filter, gas phase smoke constituents are removed; filter ventilation arranged at a location spaced downstream from the sorbent so as to lower mainstream smoke velocity through the sorbent; and the carbon comprising at least 90 to 120 mg or greater of the carbon in a fully filled condition or 160 to 180 mg or greater of the carbon in a 85% filled condition or better; and the filter ventilation being spaced from a mouth end of the cigarette by at least approximately 12 mm; wherein the cigarette achieves a significant reduction in a gas phase constituent of the mainstream smoke.

In one embodiment, a multi-component cigarette filter is provided comprising at least one sorbent-bearing flavor-releasing segment constructed and arranged to release flavor into mainstream tobacco smoke and to remove at least one smoke constituent from mainstream tobacco smoke, and at least one additional flavor-releasing segment constructed and arranged to release added flavor to mainstream smoke, the additional flavor-releasing segment comprising cellulosic flavor bearing granules located downstream of the sorbent-bearing flavor-releasing segment. The additional flavor-releasing segment may include a plug of filter material having the flavor granules therein or the sorbent-bearing flavor-releasing segment may include activated carbon with flavorant on the carbon. The sorbent-bearing flavor-releasing segment may include three filter components including activated carbon with flavorant on the carbon and cellulose acetate tow components on opposite sides of the activated carbon or the additional flavor-releasing segment may include a cellulose acetate plug with flavorant thereon. The additional flavor-releasing segment may include a cellulose acetate plug surrounded by plug wrap with flavorant on the plug wrap and the sorbent-bearing flavor-releasing segment may include carbon granules with flavorant on the granules. The sorbent-bearing flavor-releasing segment may include at least 90 to 120 mg or greater of activated carbon in a fully filled condition or 160 to 180 mg or greater of activated carbon in a 85% filled condition or better.

In another embodiment a filtered cigarette is provided wherein the filter comprises cellulosic flavor bearing granules, and the flavor granules comprise at least one volative flavorant incorporated therein. The filter may include a sorbent or the filter may not include a sorbent therein.

A method of treating mainstream tobacco smoke produced by a traditional or non-traditional cigarette having a cigarette filter at a downstream end thereof is provided, the method comprising passing mainstream tobacco smoke through the cigarette filter such that the mainstream smoke contacts cellulosic flavor bearing granules which release volatile flavor attributes into the mainstream tobacco smoke to achieve a desired taste to the mainstream tobacco smoke. The mainstream tobacco smoke may contact an upstream sorbent to remove at least one constituent of the mainstream tobacco smoke and then contact the cellulosic flavor bearing granules.

DETAILED DESCRIPTION

Figure 1:
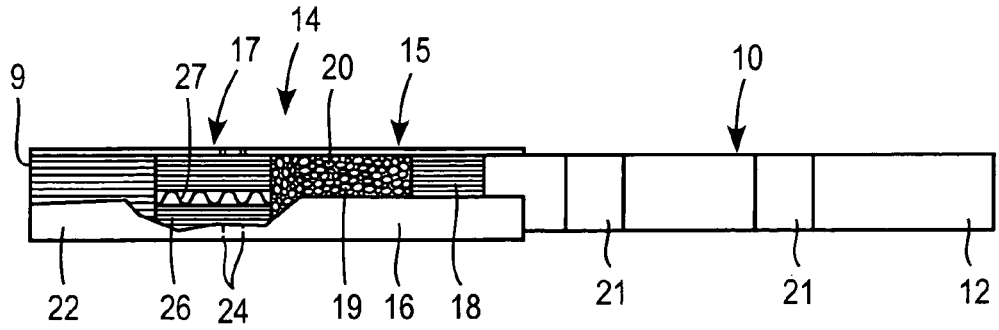
FIG. 1 is a side elevational view of a cigarette comprising a tobacco rod and a multi-component filter with portions thereof broken away to illustrate interior details.

Referring to FIG. 1, a preferred embodiment provides a cigarette 10 comprising a rod of smokable material 12 such as shredded tobacco and a multi-component filter 14 (or filter) attached to the rod 12 with a tipping paper 16. The terms "a" or "an" are intended to include one or more. Upon lighting of the cigarette 10, mainstream smoke is generated by and drawn from the tobacco rod 12 and through the multi-component filter 14.

Herein, the "upstream" and "downstream" relative positions between filter segments and other features are described in relation to the direction of mainstream smoke as it is drawn from the tobacco rod 12 and through the multi-component filter 14.

Preferably, the multi-component filter 14 comprises a first, upstream sorbent-bearing segment 15 and a mouth end (mouthpiece) component 22. The term "sorbent" is intended to include absorbent and adsorbent materials. In this first preferred embodiment, the sorbent-bearing segment 15 comprises a plug-space-plug filter sub-assembly that includes a central filter component 17, a tobacco end component 18 in spaced apart relation to the central filter component 17 so as to define a cavity 19 therebetween, and a bed of high surface area, activated carbon material 20 disposed in the cavity 19. The tobacco end component 18 is located adjacent the tobacco rod 12 and preferably, comprises a plug of cellulose acetate tow of low RTD. Preferably, the tobacco end component 18 is made as short as possible within the limits of high-speed machineability and preferably has the lowest particulate RTD amongst the filter components comprising the multi-component filter 14.

The mouth end (buccal) component 22 is preferably in the form of a cellulose acetate plug or other suitable fibrous or webbed material of moderate to low particulate efficiency. Preferably, the particulate efficiency is low, with the denier and grand total denier being selected such that the desired total RTD of the multi-component filter 14 is achieved.

Preferably the carbon of the adsorbent bed 20 is in the form of granules and the like. Preferably, the carbon of the preferred embodiment is a high surface area, activated carbon, for example a coconut shell based carbon of typical ASTM mesh size used in the cigarette industry or finer. The bed of activated carbon is adapted to adsorb constituents of mainstream smoke, particularly, those of the gas phase including aldehydes, ketones and other volatile organic compounds, and in particular 1,3-butadiene, acrolein, isoprene, propionaldehyde, acrylonitrile, benzene, toluene, styrene, acetaldehyde and hydrogen cyanide. Sorbent materials other than carbon may be used as explained below and fall within the definition of sorbent materials as used herein.

With respect to the carbon particles 20, it is preferred that they have a mesh size of from 10 to 70, and more preferably a mesh size of 20 to 50.

Preferably at least some, if not all of the sorbent bed 20 is flavor-bearing or otherwise impregnated with a flavor so that the sorbent bed 20 of the upstream sorbent bearing segment 15 is adapted not only to remove one or more gas phase smoke constituents from mainstream smoke, but also to release flavor into the mainstream smoke stream. Preferably, flavor is added to the carbon by spraying flavorant upon a batch of activated carbon in a mixing (tumbling) drum or alternatively in a fluidized bed with nitrogen as the fluidizing agent, wherein flavorant may then be sprayed onto the carbon in the bed.

Still referring to FIG. 1, the central filter component 17 of the multi-component filter 14 preferably comprises a plug 26 of fibrous filter material, preferably cellulose acetate tow of a moderate to low particulate efficiency and RTD, together with one or more flavor-bearing yarns 27. As mainstream tobacco smoke is drawn through the central filter component 17 and along the yarn 27, flavoring is released into the stream of mainstream smoke. Flavor thread bearing filter plugs may be obtained from the American Filtrona Company, 8410 Jefferson Davis Highway, Richmond, Va. 23237-1341 and a suitable construction for the central filter component 17 is described in U.S. Pat. No. 4,281,671, which patent is hereby incorporated by reference in its entirety.

In the preferred embodiment, the central filter component 17 and its flavor yarn 27 is located downstream of the flavor-bearing, carbon bed 20. In one embodiment, release of flavor is effected from both the bed 20 of flavored carbon and the flavor yarn 27 located downstream thereof, so as to achieve a balanced, consistent delivery of tastes and aromas throughout a smoking. However, flavorants can be located on either the component 17 or the carbon bed 20, standing alone, or any of the above with addition of flavorants being carried along one or more plug wraps and/or the tipping paper 16.

Preferably one or more circumferential rows of perforations 24 are formed through the tipping paper 16 at a location along the central component 17 and downstream of the bed of flavored carbon 20, preferably at the upstream end portion of the central component 17 adjacent the carbon bed 20. The preferred placement maximizes distance between the buccal end 9 of the cigarette and the perforations 24, which preferably is at least 12 mm (millimeters) or more so that a smoker's lips do not occlude the perforations 24. Furthermore, because the introduction of diluting air flows at an upstream end portion of the central segment 17, itself, lowers the particulate efficiency of the downstream portions of the segment 17, the upstream location of the ventilation along the filter component 17 facilitates design of the component 17 to provide a more elevated (yet moderate) RTD without a significant elevation of particulate efficiency, so as to help maintain a desired low particulate efficiency in the central component 17 and throughout the multi-component filter 14.

Preferably, the level of ventilation is preferably in the range of 40 to 60% and more preferably approximately 45 to 55% in a 6 mg FTC tar delivery cigarette.

It is believed that ventilation not only provides dilution of the mainstream smoke but also effects a reduction of the amount of tobacco combusted during each puff when coupled with a low particulate efficiency multi-component filter 14. Ventilation reduces drawing action on the coal and thereby reduces the amount of tobacco that is combusted during a puff. As a result, absolute quantities of smoke constituents are reduced. Preferably, the various filter components (the central filter segment 17, the tobacco end filter segment 18, the carbon bed 20 and month end component 22) are provided low particulate efficiencies and the amount of ventilation is selected such that differences between the desired FTC tar delivery of the cigarette and the output the tobacco rod 12 are minimized. Such arrangement improves the ratio of carbon monoxide content of the delivered smoke to its FTC tar level (CO to Tar ratio). In contrast, prior practices tended to first establish an output level of the tobacco rod 12 and utilized particulate filtration to drive FTC tar delivery down to a desired level. These prior practices tended to combust an excess of tobacco, and accordingly, exhibit higher CO to Tar ratios than typically achieved with preferred cigarette embodiments disclosed herein.

Advantageously, the perforations 24 are located downstream from the carbon bed 20 so that mainstream smoke velocity through the carbon bed 20 is reduced and dwell time of the main stream smoke amongst the carbon bed 20 is increased. The extra dwell time, in turn, increases the effectiveness of the activated carbon in reducing targeted mainstream smoke constituents. The smoke is diluted by ambient air passing through perforations 24 and mixing with the mainstream smoke to achieve air dilution in the approximate range of 45-65%. For example, with 50% air dilution, the flow through the cigarette upstream of the dilution perforations is reduced 50% thereby reducing the smoke velocity by 50%.

Preferably, the carbon bed comprises at least 90 to 120 mg (milligrams) or greater of carbon in a fully filled condition or 160 to 180 mg or greater of carbon in a 85% filled condition or better in the cavity 19, which in combination with the extra dwell time and flavor release as described above, provides a flavorful cigarette that achieves significant reductions in gas phase constituents of the mainstream smoke, including 90% reductions or greater in 1,3-butadiene, acrolein, isoprene, propionaldehyde, acrylonitrile, benzene, toluene, styrene, and 80% reductions or greater in acetaldehyde and hydrogen cyanide. The elevated carbon loading also assures an adequate activity level sufficient to achieve such reductions throughout the expected shelf-life of the product (six months or less).

By way of example, the length of tobacco rod 12 is preferably 49 mm, and the length of the multi-component filter 14 *m* is preferably 34 mm. The length of the four filter components of cigarette 10 in the preferred embodiment is as follows: the tobacco end component 18 is preferably 6 mm; the length of the carbon bed 20 is preferably 12 mm for carbon loading of 180 mg; the central component 17 is preferably 8 mm; and mouth end component 22 is preferably 8 mm. Overall the level of "tar" (FTC) is preferably in the range of 6 mg with a puff count of 7 or greater. All of the components 17, 18, 20 and 22 are of low particulate efficiency, and preferably, amongst all the fibrous or web segments (17, 18 and 22), the tobacco end component 18 is of lowest RTD and particulate efficiency because it is upstream of the ventilation and therefore has greater effect upon the mainstream smoke. Unlike those other fibrous or webbed components, the tobacco end component 18 receives the mainstream smoke in the absence of a diluting air stream.

Tobacco rod 12 may be wrapped with a convention cigarette wrapper or banded paper may be used for this purpose. Banded cigarette paper has spaced apart integrated cellulose bands 21 that encircle the finished tobacco rod of cigarette 10 to modify the mass burn rate of the cigarette so as to reduce risk of igniting a substrate if the cigarette 10 is left thereon smoldering. U.S. Pat. Nos. 5,263,999 and 5,997,691 describe banded cigarette paper, which patents are incorporated herein in their entirety.

Table I below provides details with respect to the various components of cigarette 10 shown in FIG. 1 of the drawing.

TABLE I

| Cigarette | 6 mg FTC Tar. 50% Ventilation |
|---|---|
| Total Cigarette Filter 14: | |
| Filter Length, mm: | 34 |
| Tipping Length, mm: | 38 |
| Filter RTD, mm $H_2O$: | 114 |
| Mouth end Component 22: | |

TABLE I-continued

| Cigarette | 6 mg FTC Tar. 50% Ventilation |
|---|---|
| Tow Item: | |
| Component RTD, mm $H_2O$: | 3.0Y denier/35,000 total denier 28 |
| Central Component 17: | |
| Tow Item: | |
| Component RTD, mm $H_2O$: | 1.8Y denier/35,000 total denier 46 (unventilated)/approx. 30 (ventilated) |
| Tobacco End Component 18: | |
| Tow Item: | |
| Component RTD, mm $H_2O$: | 5.0Y denier/35,000 total denier 15 |
| Carbon 20: | |
| Cavity Length, mm: | 12 |
| Weight, mg: | 180 |
| Cavity Component RTD, mm $H_2O$: | 25 |
| Plug Space Plug Subassembly (segment 15, (components 17, 18 and 20)): | |
| Segment RTD, mm$H_2O$: | 86 |

In understanding the above information set forth in Table 1, it should be realized that the preferred RTD of the central component 17 includes an unventilated value and ventilated value, and that with ventilation with central component 17 in accordance with the first preferred embodiment, the RTD of the central component 17 is approximately equal to that of mouth end component 22 or thereabout. Accordingly, a majority of the filter RTD is established downstream of the ventilation, and advantageously such arrangement couples the location of RTD generation with that portion subject to addition of ventilating airflow so that particulate efficiency can be maintained at lower levels, while at the same time contributing a majority of a desired total RTD for the filter.

Preferably, the tobacco end component 18 is that component having the lowest RTD and particulate efficiency because it is upstream of the ventilation and subject to an undiluted stream of mainstream smoke. By such arrangement, the impact of the tobacco end component in removing tar is minimized so that tar output of the tobacco rod is minimized and the amount of tobacco burned per puff is in turn minimized.

In the preferred embodiment, the particulate efficiency for the entire multi-component filter 14 is preferably in the range of approximately 40 to 45% as measured under USA/FTC smoking conditions (35 cubic centimeter puff over two seconds).

In the preferred embodiment, it is preferable to load approximately 180 mg of carbon plus or minus approximately 10 mg of carbon to achieve a average 85% fill in a 12 mm cavity at the more traditional cigarette circumferences (approximately 22 to 26 mm). This level of fill together with that amount of carbon will achieve 90% tar weighted reduction of acrolein and 1,3-butadiene relative to an industry standard, machine made cigarette (known as a 1R4F cigarette).

Lower carbon loadings can be utilized to equal effect as one approaches a fully filled condition of 95% or greater. With carbon loadings in the range of 70 to 100 mg and more particularly in the range of 90 to 120 mg compacted, fully filled plug-space-plug filters provide 90% or greater reduction in acrolein and 1,3-butadiene in relation to levels of such in 1R4F cigarettes. Such arrangement provides significant savings in amounts of carbon that may be needed to remove these smoke constituents, and offers substantial savings in costs of manufacture. The compressed and/or fully filled plug-space-plug filter configuration also provides a more consistent performance in gas phase treatment from cigarette to cigarette.

Figure 6:
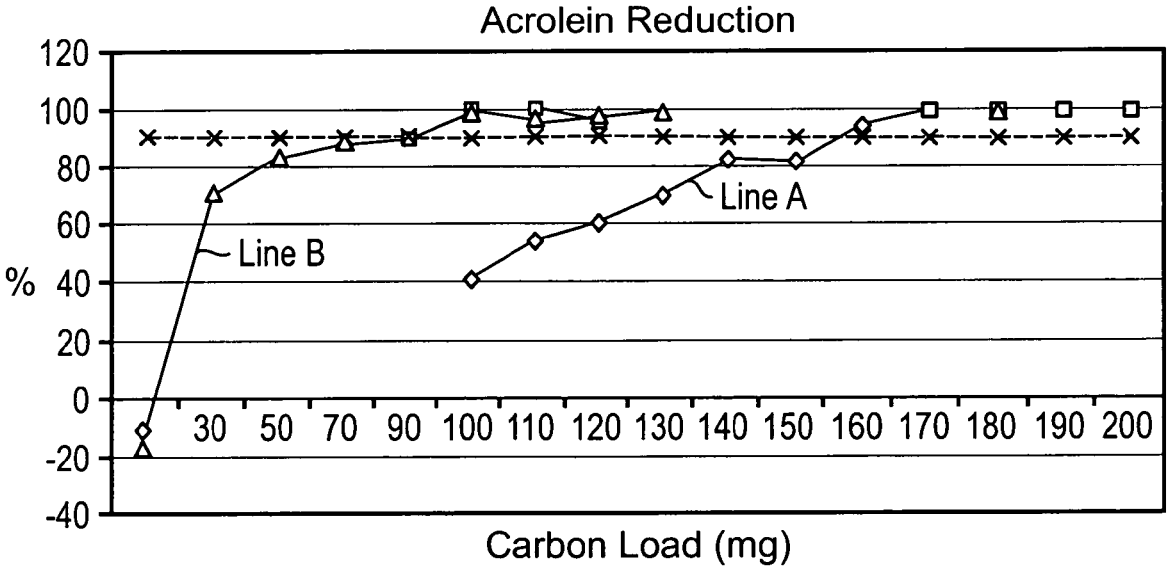
FIG. 6 is a graphical representation of carbon loading versus acrolein reduction with handmade cigarettes constructed in accordance with the preferred embodiment shown in FIG. 1.

In regard to the above and in reference to FIG. 6, Line A is a progression of data points that were established from testing hand-made cigarettes of a design as shown for the preferred embodiment of FIG. 1 and having a cavity 19 of a fixed 10 mm length so that throughout the progression of data points, volume of the cavity 19 remained constant while the amount of carbon loading was increased from 100 mg to approximately 160 mg while moving from left to right along Line A in FIG. 6. The progression indicates that when such a cavity is partially filled with a 100 mg loading of carbon (a condition wherein substantial space remains unfilled), the effectiveness of the carbon in reducing acrolein is reduced substantially.

In contrast, Line B in FIG. 6 is a progression of data points generated with cigarettes of the construction shown in the preferred embodiment, wherein, cavity space is equal to or approximately equal to carbon volume so that unfilled space is minimized and bypass flows about the carbon bed are avoided. With such change the desired effectiveness of removing acroleins is achievable with carbon loadings in the range of approximately 90 to 100 mg. Contrastingly, the partially filled cavities represented in line A do not achieve a desired 90% or more reduction of acrolein until the cavity is loaded with a much greater amount of carbon, namely 160 mg or more.

Figure 7A:
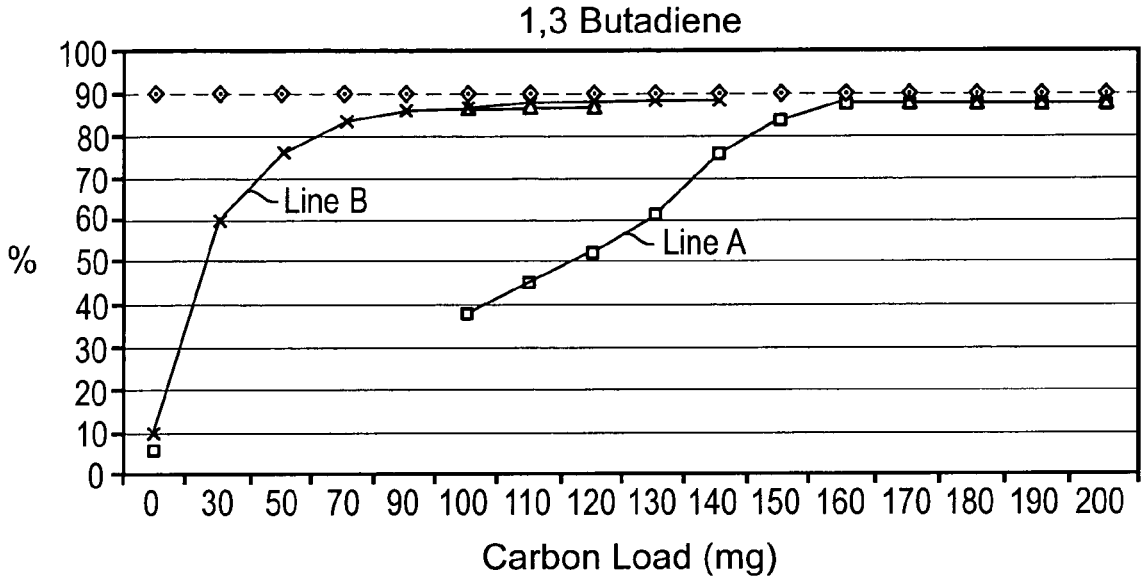
FIG. 7A is graphical representation of carbon loading versus 1,3-butadiene reduction with handmade cigarettes constructed in accordance with the preferred embodiment shown in FIG. 1.

A similar relationship is shown in FIG. 7A, wherein Line A represents a progression of data points generated with cigarettes of similar construction to that of the preferred embodiment of FIG. 1, wherein a 10 mm long cavity is maintained at constant volume while ever increasing carbon load is placed in the cavity from 100 mg to approximately 160 mg. Line B in FIG. 7A represents data from cigarettes of similar construction to that of the preferred embodiment but wherein the volume of the cavity is approximately equal to that of the carbon so that unfilled space is minimized and bypass flows are avoided. This data indicates that a filter in a fully filled condition of approximately 80 to 100 mg is adequate for achieving a desired level of reduction in 1,3-butadiene (90% removal or better), whereas such occurs at line A at a substantially great quantity (approximately 160 mg).

The trends exhibited in FIG. 7A at Line A and the supporting data of Line A indicate that on the average a 160 mg carbon loading at approximately 85% fill will achieve approximately a 90% reduction in 1,3-butadiene. It is noted that the supporting test data was generated utilizing a test method whose lower limit of quantification is less than 0.45 micrograms, whereas a 90% reduction of 1,3-butadiene as shown in FIG. 7A equates approximately to 0.42 micrograms of 1,3-butadiene (per calculations). Accordingly, the effectiveness of the carbon loadings near 90% reduction of 1,3-butadiene might actually be greater than a 90% reduction.

Figure 7B:
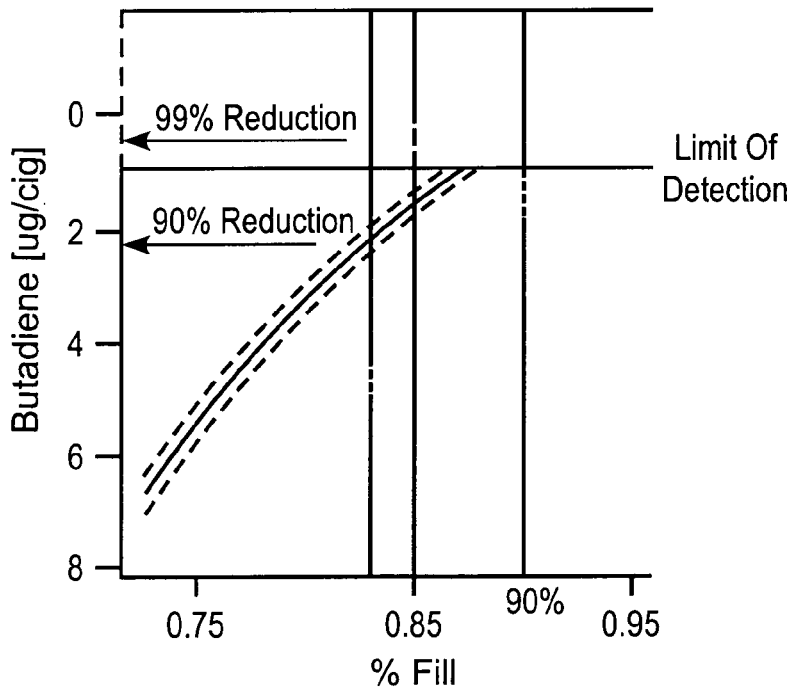
FIG. 7B is graphical representation of carbon loading versus levels of 1,3-butadiene with machine made cigarettes constructed in accordance with the preferred embodiment shown in FIG. 1 with a 12 mm long cavity.

FIG. 7B is graphical representation of carbon loading versus levels of 1,3-butadiene with machine made cigarettes constructed in accordance with the preferred embodiment shown in FIG. 1 with a 12 mm long cavity 19. The fill level was determined using an untamped fill methodology with a gauge cylinder. The trends shown therein indicate that machine made cigarettes constructed with a target fill percentage of 83%, will produce approximately a 90% reduction of 1,3-butadiene in relation to levels of such in 1R4F cigarettes. A target average of 85% or greater percent fill will yield a greater than a 90% reduction of 1,3-butadiene in relation to levels of such in 1R4F cigarettes in a 12 mm cavity, using a high surface area, activated carbon.

Preferably, the high surface area carbon has a specific surface area (square meters per gram) of approximately 1000 square meters per gram or greater.

Smoking tests have been conducted by taste experts with cigarettes that were similar in layout to that of the preferred embodiment shown in FIG. 1. When smoking such cigarettes comprising a flavor yarn element 27 located downstream of an unflavored carbon bed 20, they reported the presence of a flavorful tobacco note during the first several puffs, but that in the latter several puffs, less desirable flavor notes that are recognized as typical of more traditional "charcoal" cigarettes were detected. Additionally, when smoking such test cigarettes comprising a flavored carbon bed 20 but no flavor release element 27 downstream of the flavored carbon bed 20, expert smokers reported that the first several puffs had the less desirable flavor notes typical of more traditional "charcoal" cigarettes, but that after the first several puffs a more flavorful tobacco note was experienced. In contrast, when expert smokers smoked cigarettes of similar construction to that of the preferred embodiment of FIG. 1, including a flavor yarn element 27 located downstream of a bed of flavored carbon 20, they reported a more balanced tobacco smoke throughout all puffs of the test cigarettes.

Not wishing to be bound by theory, it is believed that the filter segments operate together to release flavor into the smoke stream and both sources of flavor provide balance to the aromas and taste of the mainstream smoke throughout a smoking. It is further believed that the bulk of the flavor in central component 17 from the flavor yarn 27 is released early and such release diminishes over time while the flavor released from the carbon bed 20 increases over time with more of the flavor released later in the smoking of the cigarette. Having flavors on both the carbon bed 20 and in or about the central component 17 balance flavor delivery and improve shelf life of the cigarette 10.

In the preferred embodiment of FIG. 1 and the others, the preferred amount of flavorant loading is 3 to 6 mg in the carbon 20, more preferably approximately 4 or 5 mg, and likewise, the preferred amount of flavorant loading is 3 to 6 mg in the yarn 27, more preferably approximately 4 or 5 mg. It is to be understood that reference to a 180 mg loading of flavored carbon herein is inclusive of the flavorant.

Figure 2:
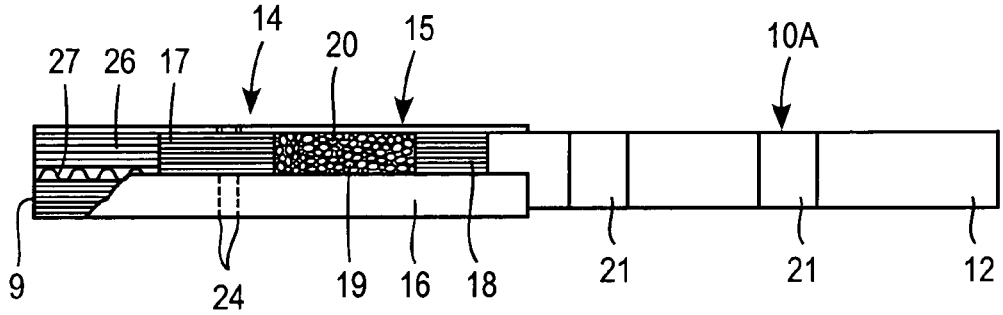
FIG. 2 is a side elevational view of a cigarette comprising a tobacco rod and a multi-component filter with portions thereof broken away to illustrate interior details.

Referring now to FIG. 2 another preferred embodiment provides a modified cigarette 10A with the same filter segments as cigarette 10 of FIG. 1, but with a slightly different mutual arrangement of the segments, and similar reference characters are used to identify similar parts. In cigarette 10A the flavor-releasing yarn element 27 is located in the mouth end component 22 at the buccal (mouth) end of the cigarette 10A, downstream from the flavored carbon bed 20 and spaced therefrom by the central component 17. In this embodiment, a plasticizer such as triacetin may be applied to the flavor yarn 27 to hold the yarn in place within component 17 and prevent the yarn from being draw out of the filter during smoking. Alternatively, the flavor yarn 27 may be braided together to achieve the same result. As in the first preferred embodiment, ventilation 24 is provided at a location along the central filter component 17 adjacent to but downstream of the flavored carbon bed 20.

Table II below provides further details and alternatives with respect to the various components of cigarette 10A of FIG. 2 of the drawing.

TABLE II

| Descriptor | Flavor-Yarn/Mouth End Component 22 | Sorbent Bearing Component 17 | Sorbent Bed 20 | Tobacco End Component 18 | Dilution Perforations 24 |
|---|---|---|---|---|---|
| Length (mm) | 7-9 | 6-8 | 10-14 | 6 | 14 mm from mouth |
| RTD (mm water) | 15-20 | 10-20 | 20-30 | 25-35 | 20-40% vent |
| Material(s) 1 | Cellulose Acetate | Cellulose Acetate | Activated Carbon | Cellulose Acetate | Pre Perf |
| 2 | Cotton Thread | | Coconut, High Surface Area 150-200 mg | Carbon on tow Carbon Paper | |
| Particulate Efficiency | 10-15% | 10-15% | 12-20% | 10-40% | |
| Alternates | CA Thread | | Impregnated Carbon APS | | |
| | Flavor on Tow | | Zeolites | | |
| | Flavor on Plug Wrap | | | | |
| | Flavored Plug Wrap | | Other Sorbents | | |

It is to be understood that the above characterizations with respect to the second preferred embodiment (FIG. 2) are applicable to those of the first preferred embodiment (FIG. 1), realizing of course, that in the latter embodiment (FIG. 1), the flavor yarn 27 is located in the central filter component 17. The latter arrangement presents a more traditional appearance to the buccal end of the cigarette 10.

Figure 3:
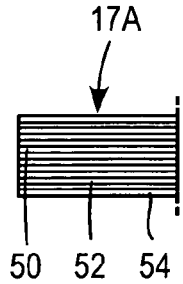
FIG. 3 is a fragmental sectional view of a modified downstream flavor-releasing segment.

FIG. 3 illustrates an alternate embodiment of the additional flavor-releasing component 17 shown in FIGS. 1 and 2. Specifically, the flavor-releasing component 17A shown in FIG. 3 comprises a cellulose acetate plug 50 of low particulate efficiency surrounded by a plug wrap 52. Combining wrap 54 surrounds the plug wrap as well as the remaining components of the multi-component filter 14 (not shown). Flavor is applied to the plug wrap 52 or to the outside of the cellulose acetate plug 50 for imparting flavor to the cigarette smoke as it passes through plug 50. Alternatively, flavor may be applied to the combining wrap 54 in the area of cellulose acetate plug 50, or the flavor may be incorporated as a component of the plasticizer of plug 50.

Flavor systems may be selected for specific subjective qualities (sweetness, salivation, aroma, and so on) and selected to contain ingredients within a molecular weight range (impacting boiling points, flash points, ambient vapor pressures, and so on) for retention in granulated activated carbon. The flavor system may be stored within an activated carbon of a given specification (granular size, measured activity, ash content, pore distribution, etc.) to allow the flavor system to be released to the cigarette smoke stream in a gradual controlled manner. Not wishing to be bound by theory, it is believed that the flavor system is displaced from the activated carbon by semi-volatile components in the smoke stream that are adsorbed more strongly by the activated carbon. It is believed that these smoke components are generally of higher molecular weights than the ingredients in the flavor system. Because of the different adsorption sites inside the carbon, different adsorption energies, and potentials for heats of adsorption, are realized creating a gradual release of the flavor system as more and more of the semi-volatile smoke components are adsorbed.

Not wishing to be bound by theory, it appears that activated carbon (or other adsorbent) bearing a first adsorbate of a low heat of adsorption will release a fraction of the first adsorbate in the presence of a second adsorbable agent having a greater heat of adsorption. It is believed that even with highly loaded activated carbon, some activity sites in the carbon are yet, still available for adsorption of the second adsorbable agent, and when such is adsorbed, the released heat of adsorption is available to release a fraction of the first adsorbent from the carbon. More particularly, the activated carbon 20 is at first loaded with a flavorant, which preferably has a sufficiently low heat of adsorption in relation to heats of adsorption of organic gas constituents of mainstream smoke. It is believed that the interaction between remaining activity sites in the flavorant-bearing carbon 20 and the organic gas constituents of passing mainstream smoke that have the higher heats of adsorption to produce heat which drives off (releases) a fraction of the flavorant into the passing mainstream smoke.

Figure 4:
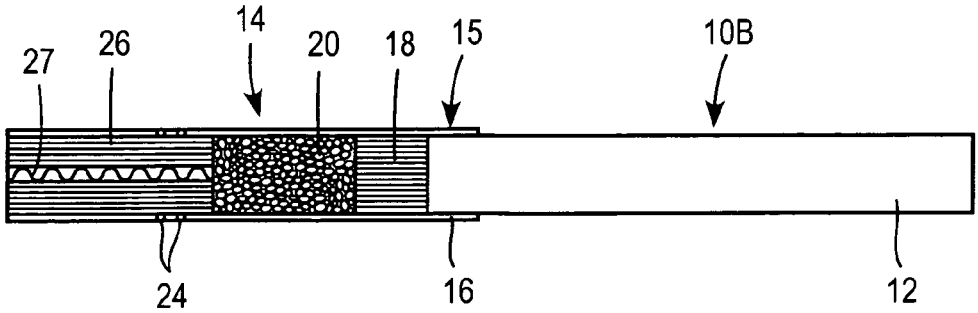
FIG. 4 is a side elevational view of still another cigarette comprising a tobacco rod and multi-component filter with portions broken away to show interior details.

FIG. 4 shows another cigarette 10B comprising a tobacco rod 12 and a multi-component filter 14 attached to the rod with tipping paper 16. Multi-component filter 14 comprises a plug-space-plug, carbon filled type of filter segment 15 wherein a generous bed of flavored carbon material 20 is disposed between first and second filler plugs 18, 26. Preferably, the plugs 18 and 26 each comprises a cellulose acetate tow of low particulate efficiency, and tow 26 includes one or more flavor-bearing yarns 27. Also, cellulose acetate plug 18 may be sprinkled with carbon, if desired.

The activated carbon material 20 serves as an adsorbent of smoke constituents of mainstream smoke, for example aldehydes, ketones and other volatile organic compounds. The activated carbon material may have the flavorant on the surface thereof and such flavoring is released into mainstream smoke during smoking of cigarette 10B.

Perforations 24 at or about plug 26 provide both dilution of the mainstream smoke by ambient air and a reduction of the amount of tobacco combusted during each puff. Ventilation reduces production and delivery of particulate (tar) and gas phase (co) constituents during a puff.

Figure 5:
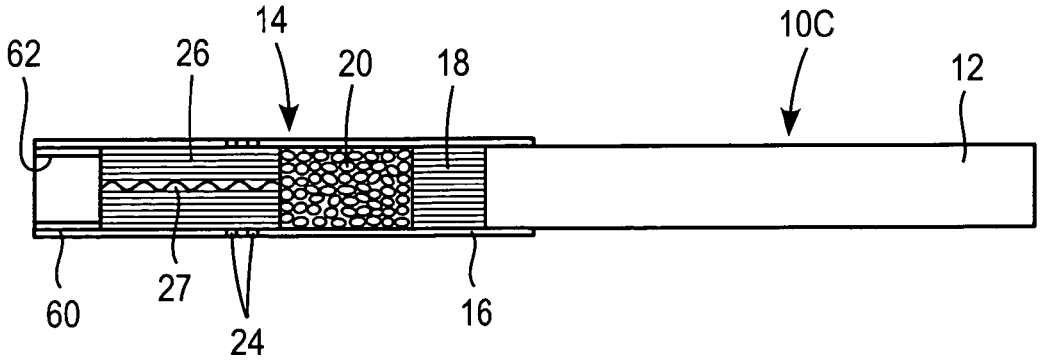
FIG. 5 is a side elevational view of another cigarette comprising a tobacco rod and a multi-component filter with portions broken away to show interior details.

FIG. 5 shows a cigarette 10C very similar to the cigarette 10B illustrated in FIG. 4, and similar reference characters have been used to identify similar parts. However, cigarette 10C is recessed at the buccal end 60, and heavy tipping paper 62 may be utilized.

Figure 8:
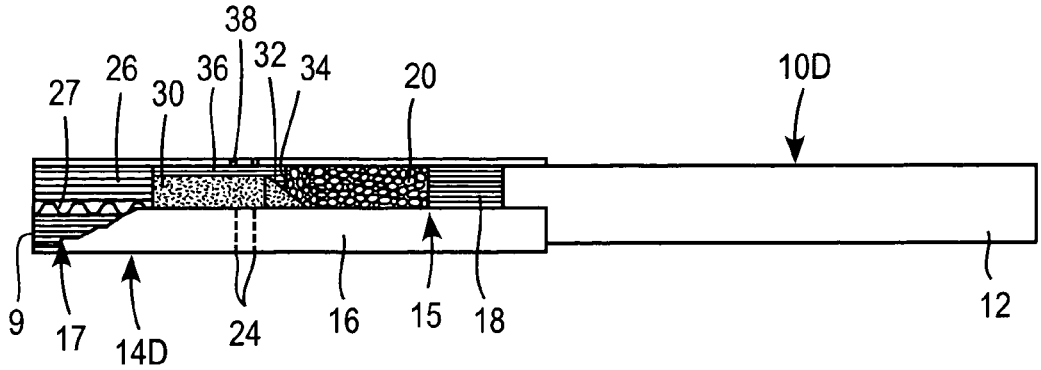
FIG. 8 is a side elevational view of another cigarette comprising a tobacco rod and a multi-component filter with portions thereof broken away to illustrate interior details.

FIG. 8 illustrates another cigarette 10D where components similar to those of cigarette 10A (FIG. 2) are identified with similar reference numerals. Cigarette 10D also includes a multi-component filter 14D and an RTD filter plug 30 is used in place of the second cellulose tow 22 of cigarette 10A. Filter plug 30 is positioned between the activated carbon material 20 and flavor-releasing component 17, and the plug 30 may comprise an impervious hollow plastic tube closed by crimping at the upstream end thereof. U.S. Pat. No. 4,357,950, describes such a plug, which patent is hereby incorporated herein by reference, in its entirety. In the alternative, such filter components may be obtained from the aforementioned American Filtrona Company of Richmond, Va. As a result of filter plug 30, a transition region 32 is provided from a generally circular cross-sectional region 34 of activated carbon material 20 having a low pressure drop to a generally annular cross-sectional region 36 having a high pressure drop. This transition region and the downstream location of perforations 24 results in high retention or residence times for the mainstream smoke upstream of the perforations. As a result, favorable reduction in gas phase constituents is achieved per puff of cigarette 10D, along with favorable dilution by ambient air and acceptable drawing characteristics. Flavor is released to the diluted mainstream smoke as it passes through the flavor-releasing component 17. As in the other preferred embodiments, it is preferred that the sorbent bed 20 comprises a flavor-bearing, activated carbon.

By way of example, the length of tobacco rod 12 of cigarette 10D may be 45 mm, and the length of multi-component filter 14D may be 38 mm. The length of the four filter segments of multi-component filter 14D is as follows: cellulose acetate tow 18 is 6 mm; carbon material length is 10 mm; filter plug 30 is 14 mm; and the flavor-releasing component 17 is 8 mm. Overall, the level of FTC tar may be 4 to 10 mg.

The filter plug 30 may also include a low efficiency cellulose acetate tow 38 on the outside thereof. The transition 32 from the generally circular cross-section 34 to the generally annular cross-section 36 and the downstream location of the air dilution perforations 24 increases the pressure drop and increases the retention time of the smoke in contact with the carbon in the filter plug 20. The smoke is diluted by air passing through perforations 24 and mixing with the smoke to achieve air dilution in the approximate range of 45-65%. For example, with 50% air dilution, the flow through the cigarette upstream of the dilution perforations is reduced 50% thereby reducing the smoke velocity by 50% which basically increases the dwell time in the filter plug 20 by a factor of two. This embodiment of the multi-component filter positions the maximum amount of carbon material upstream of the air dilution perforations 24.

Figure 9:
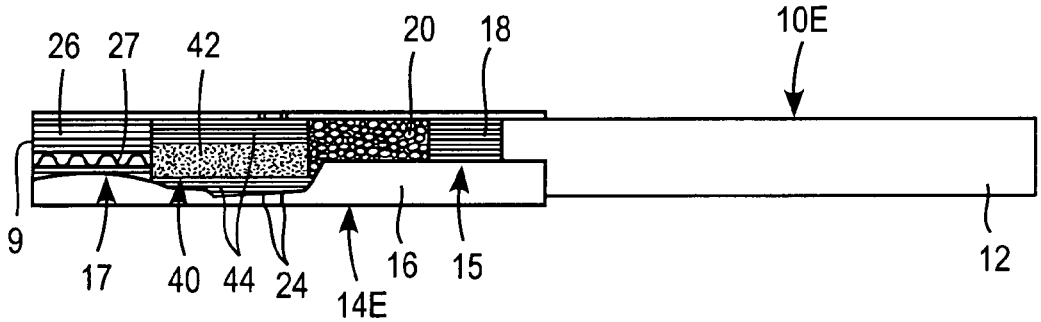
FIG. 9 is a side elevational view of still another cigarette comprising a tobacco rod and a multi-component filter with portions thereof broken away to illustrate interior details.

A crimped plastic tube has been used in cigarette 10D as a member which is substantially impervious to gas or vapor phase components for affecting a transition from a high retention time region to a high pressure drop region. It is contemplated that other shapes, such as conical or blunt ends can be used. In addition, a solid member, such as one made of high density (and hence impervious) cellulose acetate tow or a solid rod can also be used such as shown in FIG. 9, for example, and described below. Other impervious membrane structures are also contemplated.

Also, as noted above tobacco rod 12 may be wrapped with conventional paper or banded paper may be used for this purpose. Banded cigarette paper has spaced apart integrated cellulose bands that encircle the finished tobacco rod of cigarette 10D to modify the mass burn rate of the cigarette. Additionally, a sorbent-bearing component may be used alone or in combination with the sorbent-bearing segment 15 of multi-component filter 14D if desired.

Table III below provides further details and alternatives with respect to the various components of cigarette 10D illustrated in FIG. 8 of the drawing.

TABLE III

| | Mouth End Component 26 | RTD Producing Component 30 | Adsorbent Bed 20 | Tobacco End Component 18 | Dilution Perforations 24 |
|---|---|---|---|---|---|
| Length (mm) | 6-8 | 14-16 | 10-12 | 6 | 19 mm from mouth |
| RTD (mm water) | 15-20 | 70-80 | 20-30 | 15-20 | 40-65% vent |
| Particulate Efficiency | 10-15% | 15-20% | 15-20% | 10-20% | |
| Material(s) | Cellulose Acetate Cotton Thread | COD* RTD Producer | Activated Carbon Coconut, High Surface Area 120-180 mg | Cellulose Acetate Carbon on tow Carbon Paper | Pre Perf |
| Alternates | CA Thread Flavor on Tow Flavor on Plug Wrap Flavored Plug Wrap | Concentric Core TWA** Tube in Tow | Impregnated Carbon APS Zeolites Other Sorbents | | |

*COD—Carbon Monoxide Dilution
**TWA (Thin Wrapped Acetate)

FIG. 9 illustrates another cigarette 10E and components similar to those of cigarette 10D are identified with similar reference numerals. Cigarette 10E also includes a multi-component filter 14E but a concentric core filter plug 40 is used in place of the "COD" or carbon monoxide dilution filter plug 30 of cigarette 10D. Filter plug 40 is positioned between the activated carbon material 20 and flavor releasing component 17, and the plug 40 may comprise a highly impervious solid cylindrical rod 42 surrounded by a low efficiency cellulose acetate tow 44 on the outside thereof. As a result of filter plug 40 a sharp transition region is provided from a generally circular cross-sectional region of activated carbon material 20 having a low pressure drop to a generally annular cross-section region having a high pressure drop. This transition and the downstream location of perforations 24 results in high retention or residence times for the mainstream smoke upstream of the perforations, as explained above with respect to cigarette 10D of FIG. 8.

By way of example, the length of tobacco rod 12 of cigarette 10E may be 45 mm, and the length of multi-component filter 14E may be 38 mm. The length of the four filter components of multi-component filter 14E is as follows: cellulose acetate tow 18 is 6 mm; carbon material length is 10 mm; filter plug 40 is 14 mm; and the flavor-releasing component 17 is 8 mm. Overall, the level of "tar" may be 4 to 10 mg.

In cigarette 10E, the smoke is diluted by air passing through perforations 24 and mixing with the smoke to achieve air dilution in the approximate range of 45 to 65%. As in the case of cigarette 10D, with 50% air dilution, the flow through cigarette 10E upstream of the dilution perforations is reduced by 50% thereby reducing the smoke velocity by 50% which basically increases the dwell time in the filter plug 20 by a factor of two.

Tobacco rod 12 of cigarette 10E may be wrapped with conventional or banded paper, as described above, and a sorbent-bearing segment may be used alone or in combination with the sorbent bearing segment 15 of multi-component filter 14E, if desired.

Alternatively, the concentric filter plug 40 may be constructed so that the flow therethrough is essentially through the core with limited flow through the annular space outside the core.

Figure 10:
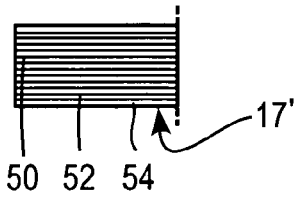
FIG. 10 is a fragmental sectional view of a modified downstream flavor-releasing segment.

FIG. 10 illustrates an alternate embodiment of the flavor releasing component 17 shown in FIGS. 8 and 9. Specifically, the flavor-releasing component 17' shown in FIG. 10 comprises a cellulose acetate plug 50 of low particulate efficiency surrounded by a plug wrap 52. Combining wrap 54 surrounds the plug wrap as well as the remaining components of the multi-component filter. Flavor is applied to the plug wrap 52 or to the outside of the cellulose acetate plug 50 for imparting flavor to the cigarette smoke as it passes through plug 50. Alternatively, flavor may be applied to the combining wrap 54 in the area of cellulose acetate plug 50, or the flavor may be incorporated as a component of the plasticizer of plug 50.

Figure 11:
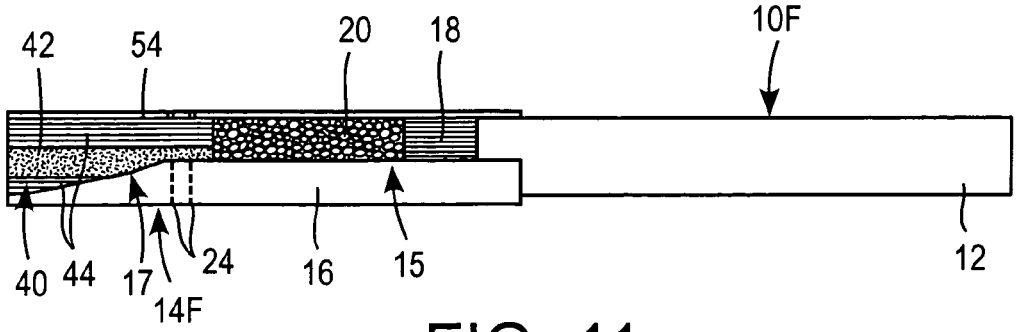
FIG. 11 is a side elevational view of another cigarette comprising a tobacco rod and a multi-component filter with portions thereof broken away to illustrate interior details.

FIG. 11 illustrates another cigarette 10F and components similar to those of cigarette 10E are identified with similar reference numerals. Cigarette 10F includes a multi-component filter 14F that comprises an upstream adsorbent bearing segment 15 adapted to remove one or more smoke constituents from mainstream smoke passing therethrough, and a downstream flavor-releasing component 17 for releasing flavor into mainstream smoke passing therethrough.

Flavor-releasing component 17 of cigarette 10F is different in that it comprises a filter plug 40 positioned downstream of the activated carbon material 20. Plug 40 comprises a relatively or highly impervious solid cylindrical rod 42 surrounded by a low efficiency cellulose acetate tow 44, and the construction and function of plug 40 is similar to that shown in FIG. 9. However, the plug 40 shown in FIG. 11 includes flavor on the combining wrap 54 which is released onto the mainstream smoke flowing through component 17.

By way of example, the length of tobacco rod 12 of cigarette 10F may be 45 mm, and the length of multi-component filter 14F may be 38 mm. The length of the three filter components of multi-component filter 14F is as follows: cellulose acetate tow 18 is 6 mm; carbon material length is 16 mm; and the plug 40 is 16 mm. Overall the tar level may be 4 to 10 mg.

In cigarette 10F, the smoke is diluted by air passing through perforations 24 and mixing with the smoke to achieve air dilution in the approximate range of 45 to 65%. Such dilution also serves to increase the dwell time of the smoke amongst the carbon granules 20, as explained above.

One or more rows of perforations 24 at or about the plug 40 provide both dilution of the mainstream smoke by ambient air and a reduction of the amount of tobacco combusted during each puff. Ventilation reduces production and delivery of particulate (tar) and gas phase (CO) constituents during a puff.

The additional flavor-releasing component 17 of the multi-component filter 14, 14D, 14E preferably comprises a plug 26 of cellulose acetate tow of low particulate efficiency together with one or more flavor-bearing threads or tapes 27. Plug 26 is located at the mouth or buccal end of the cigarettes shown in FIGS. 2, 4, 5, 8 and 9 in a downstream position. As the mainstream tobacco smoke is drawn through the threads or tapes 27 flavoring is released into the smoke to produce a desired effect. As noted above, U.S. Pat. No. 4,281,671, incorporated herein by reference, describes tobacco smoke filters that include threads and tapes with flavoring materials.

While various embodiments have been described above, it is recognized that variations and changes may be made thereto. For instance, the plug-space-plug segment 15 or the carbon bed 20 might be replaced with an agglomerated carbon element or other form of sorbent that is adapted to remove gas phase constituents from mainstream smoke. In this regard, the carbon bed may also comprise a combination of carbon and fibers. Also, the plug components might be constructed of filter materials other than those specifically mentioned herein. The ventilation might be constructed using known on-line or off-line techniques.

In accordance with a further embodiment, the flavor releasing component is in the form of cellulosic flavor bearing granules. The cellulosic flavor bearing granules are preferably located in a portion of the filter downstream of a sorbent material (such as activated carbon) so that flavor released from the flavor granules does not pass through the sorbent. Thus, deactivation of the sorbent by released flavors from the flavor granules can be substantially avoided delivery of flavor can be enhanced since the released flavor does not travel through the sorbent during smoking. Not wishing to be bound by theory, at the downstream location of the flavor granules, the temperature of tobacco smoke passing through the filter is in a cooled condition, essentially at or about room temperature. Despite the absence of heat from the cigarette coal (or any addition of moisture) it has been found that the cellulosic flavor bearing granules are effective in releasing flavor into the mainstream smoke so as to produce a flavored smoke. Preferably, the flavor compounds are released into the mainstream tobacco smoke under essentially ambient conditions. It has been found that when the granules include after-cut (or top) flavors, the cigarette produces a smoke which overcomes the objectionable taste notes usually associated with carbon bearing ("charcoal") cigarettes.

FIGS. 12-16 show exemplary layouts of filter arrangements incorporating flavor granules downstream of a sorbent preferably in the form of beaded and/or particulate activated carbon. Although certain dimensions are disclosed with reference to the embodiments shown, such dimensions can be varied to provide different amounts of sorbent or flavor granules in the filters.

Figure 12:
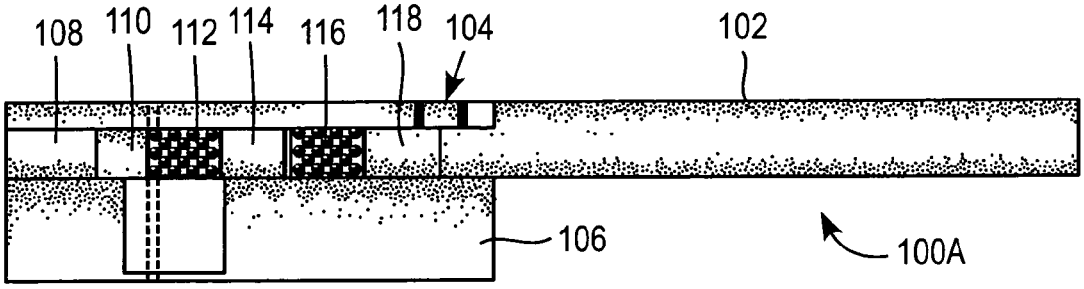
FIGS. 12-13 are side views of cigarettes having filters with upstream sorbent granules and downstream flavor granules.

In FIG. 12, a cigarette 100A includes a tobacco rod 102 which is preferably 49 mm long, and a filter 104 which is preferably 34 mm long held together by tipping paper 106. The filter 104 includes segments of filter material and two cavities which contain granular material, i.e., flavor granules in one cavity and a sorbent preferably in the form of beaded and/or particulate activated carbon in another cavity. From the mouth end of the filter, the segments include a 7 mm long cellulose acetate ("CA") plug 108, a 5 mm long CA plug 110, a 6 mm long cavity 112 containing flavor granules, a 5 mm long CA plug 114, a 6 mm long cavity 116 containing beaded carbon, and a 5 mm long CA plug 118. The filter can be manufactured by making and filling upstream and downstream plug-space-plug sections in sequence or simultaneously. For instance, a continuous rod can be manufactured with repeating segments corresponding to the CA plug 110, cavity 112 containing flavor granules and CA plug 114 wrapped in paper and the rod can be cut into 16 mm long sections, each section comprising segments 110, 112 and 114. The sections with segments 110, 112 and 114 can be formed into a second continuous rod which includes the cavity 116 containing beaded and/or particulate activated carbon and the CA plug 118 wrapped in paper and the rod can be cut into 27 mm long sections, each section comprising segments 110, 112, 114, 116 and 118. These sections can then be combined with CA plug 108 to form filters 104.

Figure 13:
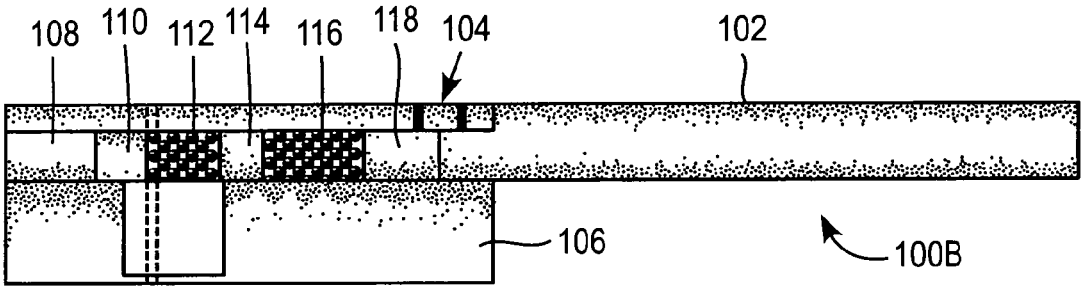

In FIG. 13, a cigarette 100B includes a tobacco rod 102 which is 49 mm long, and a filter 104 which is 34 mm long held together by tipping paper 106. The filter 104 includes segments of filter material and two cavities which contain granular material, i.e., flavor granules in one cavity and beaded and/or particulate activated carbon in another cavity. From the mouth end of the filter, the segments include a 7 mm long CA plug 108, a 5 mm long CA plug 110, a 4 mm long cavity 112 containing flavor granules, a 5 mm long CA plug 114, an 8 mm long cavity 116 containing beaded and/or particulate activated carbon, and a 5 mm long CA plug 118. The filter can be manufactured by making upstream and downstream plug-space-plug sections. For instance, a continuous rod can be manufactured with repeating segments corresponding to the CA plug 110, cavity 112 containing flavor granules and CA plug 114 wrapped in paper and the rod can be cut into 14 mm long sections, each section comprising segments 110, 112 and 114. The sections with segments 110, 112 and 114 can be formed into a second continuous rod which includes the cavity 116 containing beaded carbon and the CA plug 118 wrapped in paper and the rod can be cut into 27 mm long sections, each section comprising segments 110, 112, 114, 116 and 118. These sections can then be combined with a CA plug 108 to form filters 104.

Figure 14:
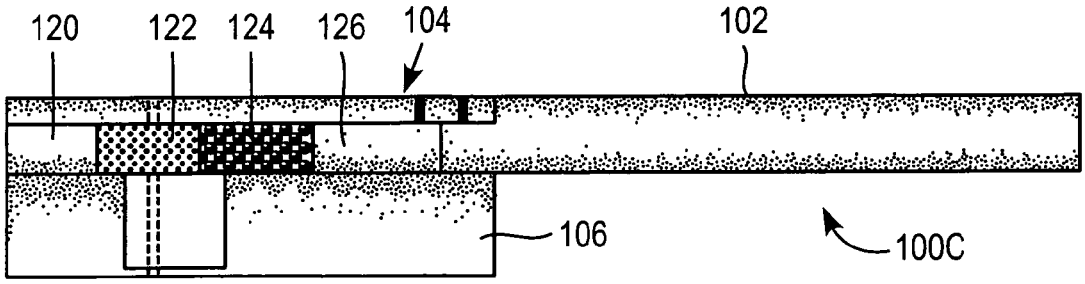
FIG. 14 is a side view of a cigarette having a filter with upstream sorbent granules and downstream plug of filter material containing flavor granules.

In FIG. 14, a cigarette 100C includes a tobacco rod 102 which is 49 mm long, and a filter 104 which is 34 mm long held together by tipping paper 106. The filter 104 includes segments of filter material and one cavity containing granular material, i.e., beaded and/or particulate activated carbon in a cavity and flavor granules in a plug of filter tow material. From the mouth end of the filter, the segments include an 8 mm long CA plug 120, an 8 mm long CA plug 122 containing flavor granules that are dispersed among the fibers of the plug 122, an 8 mm long cavity 124 containing beaded carbon, and a 10 mm long CA plug 126. The filter can be manufactured as a four segment filter. For instance, a continuous rod can be manufactured with repeating segments corresponding to the CA plug 120, CA plug 122 containing flavor granules, cavity 124 containing beaded and/or particulate activated carbon and CA plug 126 wrapped in paper and the rod can be cut into 34 mm long sections, each section comprising segments 120, 122, 124 and 126.

Figure 15:
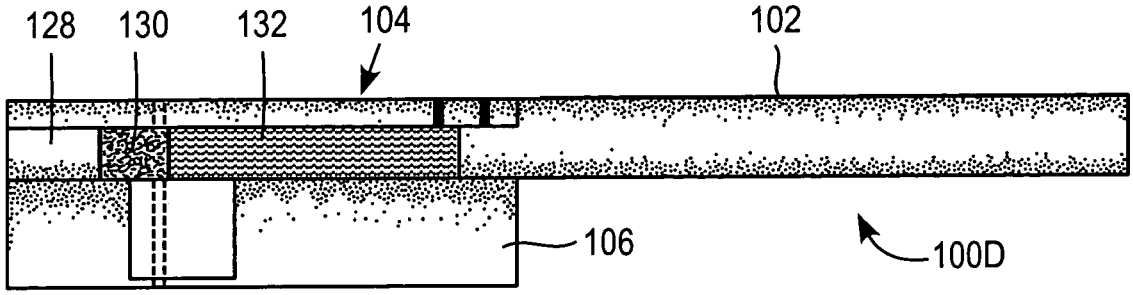
FIG. 15 is a side view of a cigarette having a filter with upstream sorbent granules and downstream flavor granules in a plug of filter tow material

In FIG. 15, a cigarette 100D includes a tobacco rod 102 which is 49 mm long, and a filter 104 which is 34 mm long held together by tipping paper 106. The filter 104 includes segments of filter material and one cavity containing granular material, i.e., flavor granules in a cavity and carbon sorbent in a plug of filter tow material. From the mouth end of the filter, the segments include a CA plug 128, a cavity 130 containing flavor granules, and a CA plug 132 having carbon sorbent incorporated (distributed) therein. The filter can be manufactured as a three segment filter. For instance, a continuous rod can be manufactured with repeating segments corresponding to the CA plug 128, cavity 130 containing flavor granules and CA plug 132 containing carbon sorbent wrapped in paper and the rod can be cut into sections, each section comprising segments 128, 130 and 132.

Figure 16:
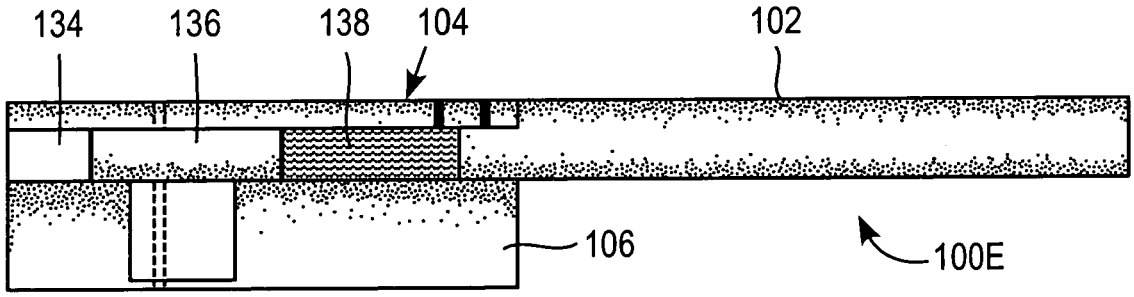
FIG. 16 is a side view of a cigarette having a filter with upstream sorbent in a plug of filter tow material and downstream flavor granules in a plug of filter tow material.

In FIG. 16, a cigarette 100E includes a tobacco rod 102 which is 49 mm long, and a filter 104 which is 34 mm long held together by tipping paper 106. The filter 104 includes three segments of filter material wherein the carbon sorbent and flavor granules are contained in plugs of filter tow material (carbon-on-tow and flavor granules-on-tow). From the mouth end of the filter, the segments include a CA plug 134, a CA plug 136 containing flavor granules and a CA plug 138 containing carbon sorbent. The filter can be manufactured as a three segment filter. For instance, a continuous rod can be manufactured with repeating segments corresponding to the CA plug 128, cavity 130 containing flavor granules and CA plug 132 containing carbon sorbent wrapped in paper and the rod can be cut into sections, each section comprising segments 128, 130 and 132.

The flavor granules preferably comprise a cellulosic material with microcrystalline cellulose being the preferred cellulosic material. Whereas various flavor carriers may need heat or water to release volatile flavor compounds into mainstream smoke, cellulosic flavor bearing granules can release such flavor constituents under ambient conditions. While any conventional cigarette flavor additives such as tobacco extracts and menthol can be incorporated in the flavor granules, it is preferred that the flavor granules incorporate flavor additives which compensate for loss of desired taste due to filtration by the upstream sorbent material. In the case of an upstream carbon sorbent, the flavor granules preferably add to the filtered mainstream smoke flavor constituents which meet the smoker's expectations for the type of cigarette being smoked, e.g., full flavor, mild flavor, or the like.

The flavor additive for the flavor granules can be incorporated in cellulosic material using a solvent mixture. A preferred solvent mixture does not impart undesired aftertastes to the mainstream smoke passing through the filter. Using a solvent mixture, it is possible to incorporate flavor constituents into the granules in minute amounts on the order of parts per million.

As is known, microcrystalline cellulose ("MCC") is a purified, partially depolymerized cellulose that is produced by treating a source of cellulose, preferably alpha cellulose in the form of pulp from fibrous plant materials, with a mineral acid, preferably hydrochloric acid. The acid selectively attacks the less ordered regions of the cellulose polymer chain thereby exposing and freeing the crystalline sites which form crystallite aggregates which constitute the microcrystalline cellulose. These are then separated from the reaction mixture, and washed to remove degraded by-products. The resulting wet mass, generally containing 40 to 60 percent moisture, is referred to in the art by several names, including hydrolyzed cellulose, hydrolyzed cellulose wetcake, level-off DP cellulose, microcrystalline cellulose wetcake or simply wetcake.

When the wetcake is dried and freed of water, the resulting microcrystalline cellulose, is a white, odorless, tasteless, relatively free-flowing powder, insoluble in water, organic solvents, dilute alkalis and acids. Microcrystalline cellulose is manufactured by FMC Corporation ("FMC") and sold under the designation Avicel® PH cellulose in several grades having average particle sizes ranging from about 20 μm to about 100 μm.

Microcrystalline cellulose and/or hydrolyzed cellulose wetcake has been modified for other uses, notably for use as a gelling agent for food products, a thickener for food products, a fat substitute and/or non-caloric filler for various food products, as a suspension stabilizer and/or texturizer for food products, and as an emulsion stabilizer and suspending agent in pharmaceutical and cosmetic lotions and creams. Modification for such uses is carried out by subjecting microcrystalline cellulose or wetcake to intense attrition forces as a result of which the crystallites are substantially subdivided to produce finely divided particles. However, as particle size is diminished, the individual particles tend to agglomerate upon drying, probably due to the hydrogen or other bonding forces between the smaller sized particles. To prevent agglomeration, a protective colloid, such as sodium carboxymethylcellulose ("CMC"), which wholly or partially neutralizes the bonding forces which cause agglomeration, may be added during attrition or following attrition but before drying. This additive also facilitates re-dispersion of the material following drying. The resulting material is frequently referred to as attrited microcrystalline cellulose or colloidal microcrystalline cellulose.

Colloidal microcrystalline cellulose is a white odorless, hygroscopic powder. On being dispersed in water, it forms white, opaque thixotropic gels. It is manufactured and sold by FMC in various grades under the designations, among others, Avicel® RC and Avicel® CL, which comprise co-processed microcrystalline cellulose and carboxymethylcellulose sodium. In FMC Product Bulletin RC-16, the grades designated as RC-501, RC-581, RC-591, and CL-611 are described as producing dispersions in which approximately 60% of the particles in the dispersion are less than 0.2 micron when properly dispersed.

While microcrystalline cellulose is a preferred cellulosic material, materials which can be used for flavor granules include CMC and other natural polysaccharides as well as their derivatives.

Flavor materials that can be used within the flavor granules are practically unlimited, although water-soluble and oil-soluble flavors are preferable. Typical water-soluble and oil-soluble flavors include lavender, cinnamon, cardamon, apium graveolens, fenugreek, cascarilla, sandalwood, bergamot, geranium, honey essence, rose oil, vanilla, lemon oil, orange oil, mint oils, cassia, caraway, cognac, jasmine, chamomile, menthol, cassia, ylang-ylang, sage, spearmint, ginger, coriander, and coffee. Each of the water-soluble or oil-soluble flavors can be used singly or mixed with others. If desired, diluent agents can be added to the natural polysaccharide or a derivative thereof and the above flavors. Diluent agents which can be used for this purpose include powdered starch such as corn starch and potato starch, rice powder, calcium carbonate, diatomaceous earth, talc, acetate powder, and pulp flock.

Any desired particle size can be obtained while maintaining the amount of the flavor content in a particle at a predetermined level. Destruction strength of a flavor granule can be controlled by an appropriate choice of the diluent agent to be used; for instance, use of calcium carbonate as a diluent agent increases the hardness of the resulting particle, whereas choice of cellulose, rice powder or starch powder reduces the hardness. By using an appropriate diluent agent, the specific gravity of a flavor granule can be adjusted to a desired level; for example, use of calcium carbonate as a diluent agent increases the specific gravity of a particle, whereas choice of starch powder results in a contrary effect.

In accordance with a preferred embodiment, the cellulosic granules can be prepared by an extrusion and spheronization technique wherein a wet mass of cellulosic material and flavoring material is extruded, the extrudate is broken up, the resulting particles are rounded into spheres and dried to produce flavor containing cellulosic granules. The wet mass can be prepared in a mixer such as a planetary mixer wherein high shear mixing occurs. The extrusion can be carried out using extruders such as the screw, sieve and basket, roll and ram type extruders. Spheronization can be carried out using a spinning friction plate which effects rounding of extrudate particles. Water is preferably used to provide the wet mass with desired rheological characteristics. For example, if the cellulosic material includes Avicel®, Emcocel® or Unimac® the water content can be adjusted to achieve the desired plasticity, e.g., the water content may range from 5 to 15% by weight. With use of liquid flavorants, the liquid content of the wet mass is preferably adjusted to account for the effect of the liquid flavorant on the rheological characteristics of the wet mass. Details of extrusion and spheronization techniques can be found in "Extrusion-Spheronization—A Literature Review" by Chris Vervaet et at, International Journal of Pharmaceutics 116 (1995) 131-146. See also U.S. Pat. No. 5,725,886. The flavoring agents can vary, and include menthol, vanillin, citric acid, malic acid, cocoa, licorice, and the like, as well as combinations thereof. See, Leffingwell et al, Tobacco Flavoring for Smoking Products (1972).

The flavorant material includes at least one or more ingredients preferably in liquid form such as saturated, unsaturated, fatty and amino acids; alcohols, including primary and secondary alcohols; esters, carbonyl compounds, including ketones and aldehydes; lactones; cyclic organic materials including benzene derivatives, alicyclics, hetero-cyclics such as furans, thiazoles, thiazolidines, pyridines, pyrazines and the like; other sulfur-containing materials including thiols, sulfides, disulfides and the like; proteins; lipids; carbohydrates; so-called flavor potentiators; natural flavoring materials such as cocoa, vanilla, and caramel; essential oils and extracts such as menthol, carvone and the like; artificial flavoring materials such as vanillin; Burley, Oriental and Virginia tobacco-like taste nuances; and the like; and aromatic materials such as fragrant alcohols, fragrant aldehydes, ketones, nitrites, ethers, lactones, hydrocarbons, synthetic essential oils, natural essential oils, including Burley, Oriental and Virginia tobacco-like aroma nuances and the like. The quantity of flavorant contained in the cellulosic granules can be chosen to provide a desired rate of delivery of volatile flavor compounds to mainstream smoke passing through the filter during smoking of the entire cigarette. The flavorant is preferably released into the mainstream smoke without heating of the cellulosic granules, i.e., the flavorant is released into the smoke at or about room temperature.

Tobacco products generally contain one or more flavors as additives for enhancement of the smoking flavor. Flavors which are added to tobacco products are normally categorized into two groups; a primary flavor group for casing sources, and a secondary flavor group for top flavors. These flavors are often added to shredded tobacco by means of a direct spraying technique which takes place during the process of manufacturing cigars or cigarettes. In accordance with one embodiment, a traditional cigarette such as a lit-end cigarette or non-traditional cigarette such as a cigarette used in an electrical smoking system (see U.S. Pat. No. 6,026,820, incorporated herein by reference) can include a standard or common tobacco mixture in the tobacco rod and appropriately flavored cellulosic granules in a filter of the cigarette can be used to achieve desired taste attributes of the cigarette.

In a further embodiment, the flavoring granules may be coated with a film suitable for minimizing migration of volatile flavor compounds during storage of cigarettes containing the flavor granules in the filter thereof. Such coatings may include natural polysaccharides or derivatives thereof.

Examples of processes for making flavor granules are set forth below.

In a first example, colloidal MCC particles are at least partially coated or occluded by a food grade barrier dispersant consisting essentially of a salt complex such as a calcium/sodium alginate salt complex. The particle size of "colloidal" MCC particles are small enough to permit the MCC particles to function like a colloid, especially in an aqueous system. The coating serves as a barrier permitting attrited MCC particles to be dried from a wetcake without undue agglomeration and acts as sealant to minimize migration of volatile flavor compounds encapsulated in the flavor granules. MCC preferably comprises 65 to 95 wt % of the MCC/alginate complex composition, preferably 70 to 90 wt %, most preferably 80 to 90 wt %, the balance to 100 wt % being the alginate complex. Within the alginate salt complex, the weight ratio of calcium:sodium is 0.43-2.33:1, preferably 1-2:1, most preferably 1.3-1.7:1, with 1.5:1 being optimum.

The calcium salts useful for affording calcium ions to the calcium/sodium alginate salt complex can be insoluble to slightly soluble (in water) where a slow reaction is desired, although more soluble salts are preferred. A slower release of calcium ions also can be achieved by acidification of the aqueous system. Useful calcium salts include, but are not limited to, calcium: acetate, carbonate, chloride, citrate, fluoride, gluconate, hydroxide, iodate, lactate; sulfate (dihydrate), and tartrate, as well as calcium/phosphorus salts including: acid calcium phosphate, calcium biphosphate, calcium phosphate (monobasic), dicalcium phosphate dihydrate, monocalcium phosphate (anhydrous), monocalcium phosphate (monohydrate), primary calcium phosphate, and tricalcium phosphate. The preferred calcium salts are calcium chloride, calcium lactate, monocalcium phosphate (anhydrous), and monocalcium phosphate (monohydrate). Calcium chloride is the most preferred calcium salt.

The attrited MCC and dissolved sodium alginate can be provided in an aqueous media in any order of addition and then introducing calcium ions to displace sodium ions until at least a barrier dispersant effective amount of a water insoluble calcium/sodium alginate complex is formed in situ, adsorbed on or otherwise coating or occluding the MCC particles. The MCC and alginate salt complex is preferably subjected to high shear conditions before drying. High shear processing of the MCC:alginate coprocessed slurry is a preferred process for achieving effective surface coverage of the finely divided MCC by the alginate salt complex.

The MCC and alginate salt complex are then further coprocessed by drying the coated particles. The drying of the coprocessed particles may be accomplished in any known manner that retains the barrier dispersant coating on the MCC particles, including spray drying and bulk drying. Spray drying is preferred.

In a further example, a hydrocolloid is added to the MCC/flavor mixture; see, for instance, U.S. Pat. Nos. 4,837,030 to Valorose, Jr. et al.; 4,844,910 to Leslie et al; 4,867,985 to Heafield et al. and 4,867,987 to Seth. A spheronizing agent capable of forming spheroids useful as flavor granules is colloidal microcrystalline cellulose. This product is made by subjecting microcrystalline cellulose to intense mechanical attrition in an aqueous medium whereby the crystallites are broken down into submicron particles. The attrited mixture is dried in the presence of sodium CMC to give water dispersible particles which form a gel when added to water. Colloidal microcrystalline cellulose and its preparation are described in U.S. Pat. No. 3,539,365 to H. W. Durand et al. It is manufactured and sold by FMC as AVICEL® RC/CL and is listed as microcrystalline cellulose and carboxymethylcellulose sodium in the U.S. Pharmacopieia/National Formulary. Spheres made therewith are described in FMC Technical Bulletin PH-65.

Although colloidal microcrystalline cellulose/carboxymethylcellulose is an effective spheronizing agent, it tends to form a sticky granulation which clings to the processing equipment necessitating frequent disassembly and cleaning. To avoid this problem, microcrystalline cellulose can be used as a purified, partially depolymerized cellulose that is produced by treating alpha cellulose in the form of pulp from fibrous plant materials, with a mineral acid, particularly hydrochloric acid. The acid selectively attacks the less ordered, i.e., amorphous regions of the cellulose polymer chain, thereby exposing and freeing the crystalline sites which constitute the microcrystalline cellulose. These are separated from the reaction mixture, washed to remove degraded by-products and dried.

The resulting microcrystalline cellulose is a white, odorless, tasteless, free-flowing powder, insoluble in water, organic solvents, dilute alkalies and dilute acids. For a fuller description of the product and its manufacture as above summarized, see U.S. Pat. No. 2,978,446 to Battista et al. Nonionic hydrocolloids can be selected from a variety of hydrophilic, physiologically compatible polymers capable of forming an aqueous solution or dispersion. These are generally known entities the description of which can be found in the periodic literature and in standard texts on polymers and resins. Illustrative examples include hydroxypropyl cellulose, hydroxypropyl methylcellulose, gelatin, water soluble cellulose acetate, polyvinylpyrrolidone, starches, sodium alginate, seed extracts such as locust bean and guar; tragacanth, arabic and karoya gums. Preferred members are hydroxypropyl cellulose, hydroxypropyl methyl cellulose and polyvinylpyrrolidone.

A preferred hydrocolloid for preparing the microcrystalline spheronization compositions is methylcellulose. Granulations containing this hydrocolloid process very cleanly in the spheronization equipment without sticking while giving a high percentage of spheroids having excellent uniformity of size distribution and sphericity.

In producing the microcrystalline cellulose spheronizing agent, a slurry of microcrystalline cellulose in an aqueous solution of the nonionic hydrocolloid is first prepared. This is accomplished by adding the microcrystalline cellulose to the aqueous hydrocolloid under intense agitation such as provided by a Cowles mixer or comparable device. The microcrystalline cellulose is preferably the non-dried material commonly referred to as wet cake, from a conventional acid hydrolysis of cellulose. Dried microcrystalline cellulose can be used provided the agitation is sufficient to break up the agglomerated cellulose crystallites formed during drying of the wet cake.

Mixing of the microcrystalline cellulose and aqueous hydrocolloid is continued until the hydrocolloid and cellulose crystallites become intimately associated. Normally, this takes about 10 to about 60 minutes when the microcrystalline cellulose is used in the form of wet cake.

The concentration of microcrystalline cellulose and hydrocolloid in the aqueous slurry is such that the weight ratios of these components in the dried solid will fall within the specified ranges of 99:1 to 70:30, microcrystalline cellulose:hydrocolloid. Generally speaking, total amounts by weight of slurry solids will vary from about 5% to about 30%.

Certain of the hydrocolloids may form viscous solutions or even gels in aqueous media making it difficult to produce a flowable slurry. This can usually be circumvented by employing a more dilute solution of the hydrocolloid.

After the blending is complete, the slurry is dried, preferably by spray drying. Conventional spray drying equipment and operating procedures are employed. Drying gas outlet temperature is ordinarily used to control residual moisture content of the co-processed particulate material. Moisture levels of about 0.5% to about 8.0% are satisfactory with preferred levels being about 3.0% to about 5.0%.

Spheroids are produced from the spheronizing microcrystalline cellulose compositions following known spheronization procedures, preferably extrusion/spheronization. Typically, a dry blend of the composition and flavor is first prepared. Water is then added slowly, with continuous mixing until a granulation of the requisite consistency is obtained. Alternatively, the flavor addition can be added as a solution to the MCC:hydrocolloid particulate composition.

The wet granulation is extruded through suitably sized pierced screens and spheronized using a rotating disk having a ground surface. The spheres are then dried in a fluidized bed or conventional oven to a moisture level of about 0.5% to about 5%. The flavor granules are produced in the form of "spheroids" having diameters in the range of about 0.1 to 2.5 mm, more preferably from 0.5 to 2 mm and most preferably from 0.8 to 1.4 mm.

In another example, an excipient composition is used in wet granulation. The excipient composition comprises particles of unattrited microcrystalline cellulose coprocessed with a low viscosity alginate. Coprocessing refers to forming and drying an aqueous slurry of microcrystalline cellulose wetcake and alginate. Microcrystalline cellulose useful in this example is unattrited microcrystalline cellulose wetcake. The alginate employed in this example is preferably low viscosity sodium alginate, but may also be a sodium, calcium salt complex of low viscosity sodium alginate. Thus, the alginate may be selected from the group consisting of low viscosity sodium alginate and a sodium, calcium complex of low viscosity sodium alginate. A suitable product for this purpose is sold by KELCO Div., Monsanto Co. as KELGIN® LV.

If it is desired to use the sodium, calcium salt complex, this salt complex of the low viscosity sodium alginate is preferably formed in situ from low viscosity sodium alginate in the manner and amounts described in U.S. Pat. No. 5,366,472 and U.S. Pat. No. 5,985,323. The weight ratio of the microcrystalline cellulose to the alginate is from about 95:5 to about 75:25, preferably from about 95:5 to about 95:15. The excipient composition described above is suitably prepared by (a) forming an aqueous slurry of unattrited microcrystalline cellulose wetcake, (b) adding the alginate and flavor addition to the stirred slurry, (c) forming a uniform slurry in which the microcrystalline cellulose, flavor component and alginate are uniformly distributed, (d) drying the uniform slurry, and (e) recovering flavor granules.

In carrying out the granulation, however, the water content of the granulated MCC/alginate excipient with the flavor component may need to be controlled for optimum functionality of the excipient/binder. Furthermore, the useful water content may vary with flavor addition. For example, the water content of the dried granulation may be in the range of 2-3 weight % or the final water content may be above 3 weight percent. If desired, various other additives may be included in the flavor granule composition, such as other binders, diluents, disintegrants, lubricants, smoke modifying agents, and the like.

One advantage of the cellulosic flavor bearing granules when used in a filter downstream of a sorbent is that addition of special flavoring additives to the tobacco rod can be omitted. Instead, the desired flavoring can be provided by the flavor granules. While the flavor granules are effective in modifying the taste of mainstream smoke passing through cigarette filters having upstream sorbents such as carbon, the flavor granules can also be used to flavor mainstream smoke in cigarettes which do not include sorbent material in the filter. This allows a standard tobacco mixture to be used in the tobacco rod of a standard lit-end cigarette and the desired taste attributes of different cigarette products (e.g., regular, mild, full flavor, etc.) to be provided by the flavor granules which contain flavorant effective to achieve the desired taste of the mainstream smoke. Similarly, the flavor granules can be used in filters of non-traditional cigarettes such as those used with electrically heated cigarette smoking systems wherein the cigarettes include standard tobacco plug and/or tobacco mat constructions and desired flavor attributes can be achieved by loading the cigarette filter with flavor granules that contribute the desired taste in the mainstream smoke.

Again, not wishing to be bound by theory, to the extent that mainstream smoke passing through the sorbent may produce heat (perhaps a heat from adsorption), the cellulosic flavor bearing granules can be located adjacent the sorbent such that heat produced at the sorbent location may be used to supplement (promote) flavor release from the granules. Additionally, it is envisioned that a catalyst or other agent may be added to the cigarette filter at an upstream location (with or without the sorbent) so as to create an exothermic event as the mainstream smoke passes through the upstream location, whereby flavor release from the cellulosic flavor bearing granules is enhanced.

The preferred embodiments are merely illustrative and should not be considered restrictive in any way. The scope of the invention is given by the appended claims, rather than the preceding description, and all variations and equivalents which fall within the range of the claims are intended to be embraced therein. For example, sorbents other than activated carbon might be employed, such as a mesoporous sieve, silica gel, or other material. Moreover, the present invention may be practiced with cigarettes of various circumferences, narrow cigarettes as well as wide. Also, while the present invention is preferably practiced with unflavored tobacco rods, flavored tobacco material is also contemplated.

What is claimed is:

1. A cigarette comprising a tobacco rod and a multi-component filter comprising a sorbent and ventilation along the filter, the sorbent and ventilation constructed and arranged to substantially remove at least one smoke constituent from mainstream tobacco smoke as mainstream smoke is drawn through the filter, and flavor-releasing cellulosic granules arranged to release flavor to mainstream smoke, the flavor-releasing cellulosic granules being located downstream of the sorbent in a direction of mainstream smoke drawn through the filter, wherein the flavor-releasing cellulosic granules include a coating effective to minimize migration of volatile flavorant constituents during storage of the cigarette, and wherein the flavor-releasing cellulosic granules comprise microcrystalline cellulose.

2. The cigarette of claim 1, wherein: (a) the sorbent comprises activated carbon in the form of beads located in a cavity in the filter and/or activated carbon particles incorporated in a plug of filter material; (b) the sorbent is disposed in a cavity defined between a tobacco end filter component and a central filter component, the cavity in a condition of being at least 85% filled; (c) the sorbent comprises a high surface area activated carbon of at least 90 mg of the carbon in a fully filled condition or 160 to 180 mg or greater of the carbon in an 85% filled condition or better; or (d) the sorbent comprises a high surface area activated carbon of at least 90 to 120 mg in fully filled condition.

3. The cigarette of claim 1, wherein a tobacco end filter component is located adjacent the tobacco rod, and a central filter component having an end portion is located adjacent the sorbent.

4. The cigarette of claim 1, wherein: (a) the ventilation is in the range of 45 to 55% and a mouth end filter component is located downstream of the flavor-releasing cellulosic granules; (b) the ventilation comprises a circumferential row of perforations through a tipping paper attaching the multi-component filter to the tobacco rod; and/or (c) the ventilation is located at least 12 mm from a buccal end of the cigarette.

5. The cigarette of claim 1, wherein: (a) the flavor-releasing cellulosic granules are contained in filter material forming a component of the filter; (b) the flavor-releasing cellulosic granules have a particle size of 0.5 to 1.5 mm; (c) the flavor-releasing cellulosic granules are contained in a cavity of the multi-component filter; or (d) the flavor-releasing cellulosic granules comprise spherical microcrystalline cellulose granules.

6. The cigarette of claim 1, wherein: (a) the multi-component filter includes a component in the form of a plug defining a flow path configured to produce an increased pressure drop, increased dwell time of mainstream tobacco smoke in the filter, and a flow constriction downstream of the sorbent; and/or (b) the multi-component filter further comprises mouth end filter component downstream of the flavor-releasing cellulosic granules.

7. The cigarette of claim 6, wherein: (a) the plug providing the flow constriction downstream of the sorbent defines an annular flow path; (b) the plug providing the flow constriction downstream of the sorbent defines a central flow path; and/or (c) the plug providing the flow constriction downstream of the sorbent comprises a concentric filter.

8. The cigarette of claim 1, including tipping paper surrounding the multi-component filter, and perforations in the tipping paper downstream from the sorbent for introducing ambient air into mainstream tobacco smoke drawn through the filter.

9. The cigarette of claim 1, wherein the filter includes plug wrap with flavorant on the plug wrap.

10. The cigarette of claim 1, wherein the cigarette achieves significant reductions in gas phase constituents of the mainstream smoke, including 90% reductions or greater in 1,3-butadiene, acrolein, isoprene, propionaldehyde, acrylonitrile, benzene, toluene and styrene.

11. The cigarette of claim 1, wherein the cigarette achieves significant reductions in gas phase constituents of the mainstream smoke, including 80% reductions or greater in acetaldehyde and hydrogen cyanide.

12. The cigarette of claim 1, wherein the cigarette is a traditional lit-end cigarette or a cigarette useful in an electrical smoking system.

13. A multi-component filter of a smoking article comprising: an absorbent-bearing segment adjacent an upstream end portion of the filter, the absorbent-bearing segment having a particulate efficiency in the range 10-20% and a lesser RTD; an RTD-inducing segment including a flow constriction and ventilation, the RTD-inducing segment being located at an intermediate location along the filter, the RTD-inducing segment having a particulate efficiency in the range of 10-20%; and flavor-releasing cellulosic granules at a downstream location along the filter, the flavor-releasing cellulosic granules having a particulate efficiency in the range 10-20% and a lesser RTD; the lesser RTD being less than an RTD of the RTD-inducing segment, wherein the flavor-releasing cellulosic granules include a coating effective to minimize migration of volatile flavorant constituents during storage of the cigarette, and wherein the flavor-releasing cellulosic granules comprise microcrystalline cellulose.

14. The multi-component filter of claim 13, wherein the ventilation is adjacent an upstream end portion of the RTD-inducing segment.

15. The cigarette of claim 1, wherein:

(a) the sorbent comprises granules in an upstream cavity and the flavor-releasing cellulosic granules are located in a downstream cavity of the filter;

(b) the sorbent comprises at least 90 mg of activated carbon granules;

(c) the flavor-releasing cellulosic granules are contained in a plug of filter material; or (d) the flavor-releasing cellulosic granules are contained in a plug of filter tow material.

* * * * *